United States Patent [19]

Griffin, Jr.

[11] 4,214,688

[45] Jul. 29, 1980

[54] TOOL MOUNTING ASSEMBLY

[76] Inventor: Groves L. Griffin, Jr., 1370 McIntosh Rd., Douglasville, Ga. 30134

[21] Appl. No.: 952,696

[22] Filed: Oct. 19, 1978

[51] Int. Cl.[3] ..... A45F 5/00

[52] U.S. Cl. ..... 224/197; 224/252; 224/269; 362/396; 362/427; 248/291

[58] Field of Search ..... 228/5 H, 26 R, 28 C, 228/5 R, 5 A, 26 B, 28 R, 5 B; 24/3 R, 3 BE; 248/316 D, 291 R, 293; 403/146, 145, 73; 362/72, 75, 82, 103, 106, 108, 197, 285, 368, 371, 418, 427, 429

[56] References Cited

U.S. PATENT DOCUMENTS

| | | | |
|---|---|---|---|
| 713,255 | 11/1902 | Traut | 403/146 |
| 1,318,850 | 10/1919 | De Yong | 224/5 H X |
| 1,349,312 | 8/1920 | Barrett | 224/5 H UX |
| 1,540,372 | 6/1925 | Sears | 224/5 H UX |
| 2,587,058 | 2/1952 | Melrose | 403/146 X |
| 3,104,897 | 9/1963 | Berger | 248/291 UX |
| 3,365,153 | 1/1968 | Baucom | 224/5 W UX |

*Primary Examiner*—Robert J. Spar
*Assistant Examiner*—Jerold M. Forsberg
*Attorney, Agent, or Firm*—B. J. Powell

[57] ABSTRACT

A tool mounting assembly for removably mounting and positioning a tool such as a flashlight which includes a base member with a raised shoulder thereon formed generally concentrically around a hole therethrough, a tool clip member for removably mounting the tool which also includes a raised shoulder thereon generally concentrically of a hole therethrough with the base member and the tool clip member positioned so that the holes are coaxially aligned and the raised shoulders are facing each other, a compression coil spring positioned between the two members and maintained generally concentrically of the holes by the raised shoulders, and a fastener rotatably extending through the holes and engaging both of the members so that the fastener limits the movement of the members away from each other at a distance which is less than the uncompressed length of the coil spring so that the coil spring resiliently forces the two members into frictional engagement with the fastener whereby the relative rotational position of the members with respect to each other are frictionally maintained yet the relative rotational positions can be manually changed by overriding the frictional engagement between the fastener and the members maintained by the spring.

8 Claims, 4 Drawing Figures

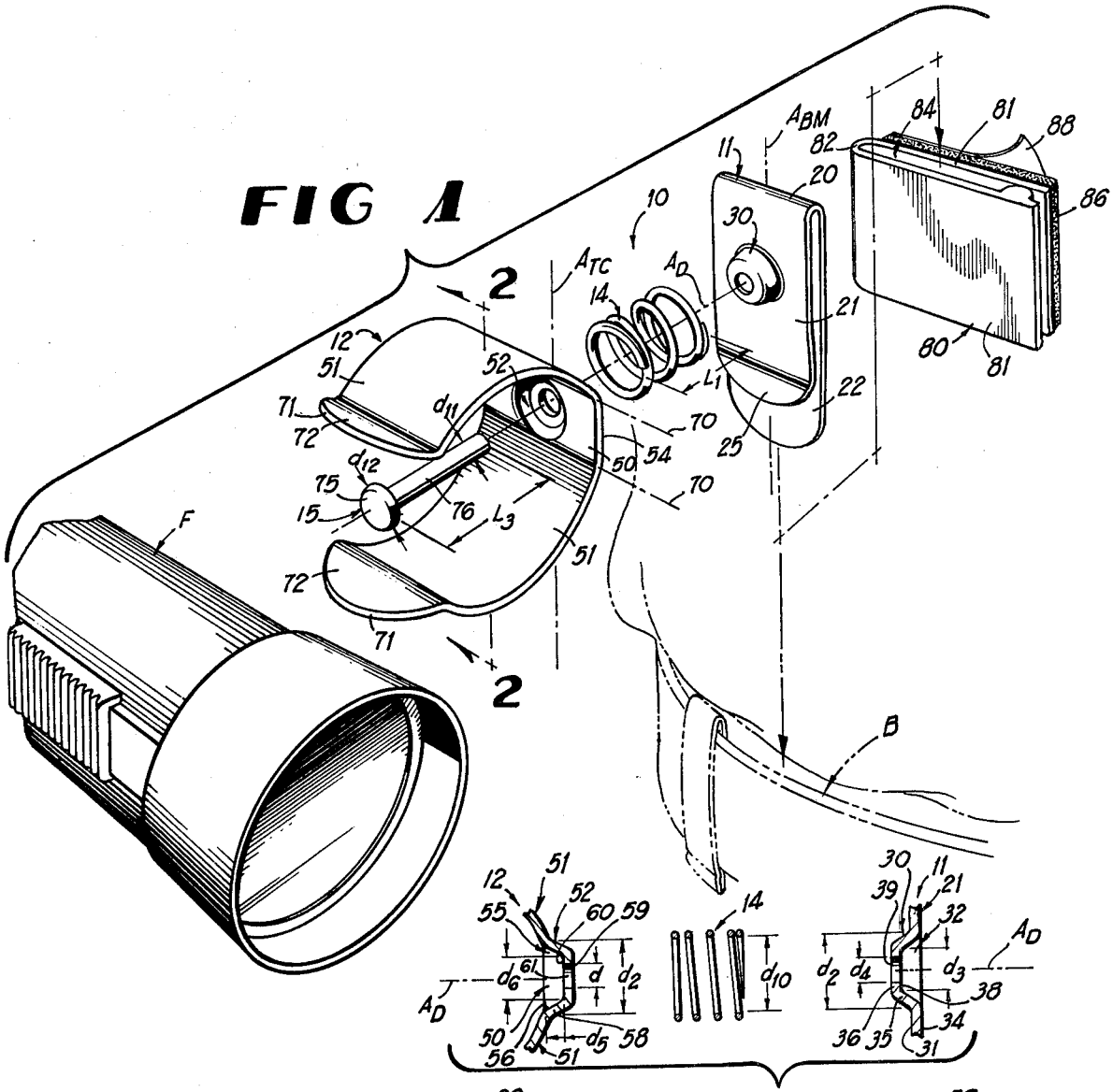
FIG 1
10
11
12
14
15
20
21
22
25
30
50
51
52
54
70
71
72
75
76
80
81
82
84
86
88
F
B
2
2
$A_{BM}$
$A_{TC}$
$A_D$
$L_1$
$L_3$
$d_{11}$
$d_{12}$
FIG 4
11
12
14
21
30
31
32
34
35
36
38
39
50
51
52
55
56
58
59
60
61
$A_D$
$d_2$
$d_3$
$d_4$
$d_5$
$d_6$
$d_{10}$
d
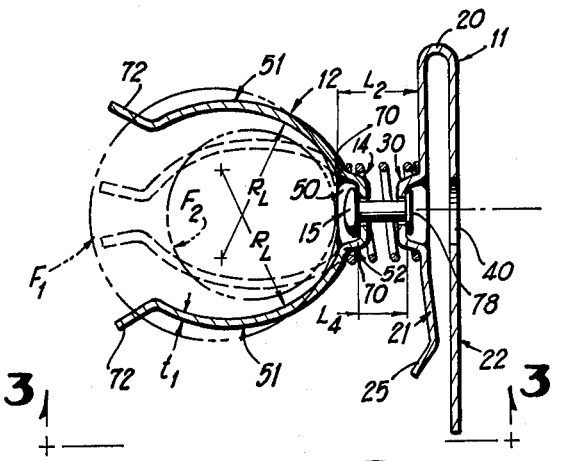
FIG 2
11
12
14
15
20
21
22
25
30
40
50
51
52
70
72
78
3
3
$F_1$
$F_2$
$R_L$
$L_2$
$L_4$
$t_1$
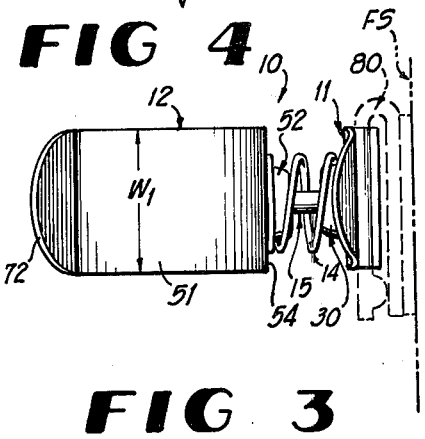
FIG 3
10
11
12
14
15
30
51
52
54
72
80
FS
$W_1$

TOOL MOUNTING ASSEMBLY

BACKGROUND OF THE INVENTION

The flashlight has become one of the most used of the portable lighting devices. It is used on a regular basis by maintenance personnel, security personnel, vehicle operators, sportsmen, and home owners. In order to effectively use the flashlight for anything other than general lighting, it is usually necessary that the flashlight be pointed at the area where the light is needed to perform a specific task. This has generally required that the flashlight be held in one hand to light the area at which the job task is to be done thereby leaving only one hand free to perform the job task. In order to free both hands, the flashlight user has resorted to a number of different attempts to properly hold the flashlight. These attempts have included propping the flashlight on some support, holding it under the user's arm, head or between his legs, or in many instances holding the flashlight in his mouth. These attempts to hold the flashlight are generally awkward, restrict the movement of the user, and do not support the flashlight in a stable manner. As a result, the flashlight was frequently dropped, sometimes damaging the flashlight and/or placing the flashlight user in a precarious position.

Mechanisms which attempt to support the flashlight have been proposed; however, these mechanisms have generally not permitted the necessary access to the flashlight, were not stable, or did not have the required versatility for the full use of the flashlight by the user.

SUMMARY OF THE INVENTION

These and other problems and disadvantages associated with the prior art are overcome by the invention disclosed herein by providing a flashlight holder which positively supports the flashlight with a sufficient versatility that allows the flashlight to be mounted on the user so that the light can be directed into the desired area at which the task is to be performed while still leaving both of the user's hands free to perform the task. The invention allows the flashlight to be quickly and easily moved to different positions on the user so that the best lighting conditions can be provided while at the same time allowing the maximum freedom of movement of the user.

The apparatus of the invention includes generally a base member with a raised shoulder thereon concentrically of a hole therethrough together with a tool clip member which removably mounts the flashlight. The tool clip member also has a raised shoulder thereon concentrically of a hole therethrough. The base member and the clip member are oriented so that the holes are generally coaxially aligned with the raised shoulders facing each other and a compression coil spring is positioned between the two members about the hole so that the coil spring is maintained generally concentrically of the holes by the raised shoulders on the two members. A fastener such as a rivet extends through the holes in the two members and serves to limit the movement of the members away from each other at a distance less than the uncompressed length of the coil spring so that the coil spring constantly forces the two members apart to maintain a frictional contact between the fastener joining the two members and the members. This frictional contact maintains the relative rotational position of the two members in respect to each other, yet allows the rotational position of the two members to be manually changed simply by overriding the frictional contact. The base member is made in the form of a clip so that it can be clipped to any convenient position on the person such as on the belt, pocket, or otherwise, and can likewise be clipped onto inanimate objects to support the flashlight. The clip member allows the flashlight to be easily and quickly removed therefrom or attached thereto so that the flashlight is readily available for use both in the holder and out of the holder. The clip base member allows the flashlight to be removed while still mounted in the holder so that the holder can be remounted in any convenient location. The locating shoulders are formed by dimples which recess the fastener out of interference with the flashlight and the user's clothing.

The clip member is made of a material which is sufficiently resilient to hold the flashlight therein yet is sufficiently inflexible to allow the clip member to be manually deformed to assume different configurations to mount different size flashlights. The holder can likewise be used to mount any tool which has a generally cylindrical section thereon that can be engaged by the clip member.

A mounting attachment may be provided for the holder which allows the flashlight and the holder to be mounted in a convenient and easily accessible location such as on the wall so that, in the event of power failure, the flashlight can be easily found to provide temporary lighting. The mounting bracket likewise removably mounts the holder so that both the flashlight and the holder can be readily removed from the mounting bracket in order for the flashlight and holder to be readily portable.

These and other features and advantages of the invention disclosed herein will become more clearly understood upon consideration of the following description and accompanying drawings wherein like characters of reference designate corresponding parts throughout the several views and in which:

BRIEF DESCRIPTION OF THE DRAWINGS

FIG. 1 is an exploded perspective view illustrating the invention;

FIG. 2 is a cross-sectional view taken generally along line 2—2 in FIG. 1 and showing the invention assembled;

FIG. 3 is an end view taken generally along the line 3—3 in FIG. 2; and FIG. 4 is a partial view similar to FIG. 2 which has been exploded apart for clarity.

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Referring to the drawings it will be seen that the invention is incorporated in a tool holder 10 which includes a base member 11, a tool clip member 12, a compression coil spring 14, and a fastener 15. The fastener 15 serves to attach the base member 11 and the tool clip member 12 together with the coil spring 14 captivated therebetween so that the coil spring 14 is always maintained in compression. Because the coil spring 14 is always maintained in compression, frictional engagement will be maintained between the fastener 15 and the base member 11, and between the fastener 15 and the tool clip member 12. This frictional engagement is such that the relative rotational positions of the base member 11 and clip member 12 will be maintained, yet the frictional engagement can be manually overridden to manually vary the relative rotational positions between the base member 11 and the clip member 12.

The base member 11 serves as a mounting clip to removably mount the tool holder 10 either on the flashlight user or on some convenient object to support both the tool holder 10 and the flashlight F partly seen in FIG. 1. The base member 11 is generally a U-shaped member formed from an elongate piece of material to provide a curved central section 20 and a pair of legs 21 and 22 integral with the ends of the central section 20 and projecting from the central section 20 generally parallel to each other to define an opening 24 therebetween. The opening 24 is closed at one end by the central section 20 and is open at the opposite end between the projecting ends of the legs 21 and 22 so that the base member 11 can be slipped over a relatively thin member such as a belt B in FIG. 1 to mount the base member 11 and thus the holder 10 on this relatively thin member. It will be noted that the rear leg 22 is longer than the front leg 21 to assist in mounting the base member 11 while the projecting end of the front leg 21 is bent outwardly to form a guide tip 25 thereon to also assist in mounting the base member 11 on the relatively thin mounting member such as belt B. The front leg 21 curves slightly toward the rear leg 22 adjacent the tip 25 so that the base member 11 resiliently engages the relatively thin mounting member such as the belt B to retain the base member 11 thereon. Thus, it will be seen that the base member 11 has a longitudinal axis $A_{BM}$ which extends therethrough. The projecting ends of the legs 21 and 22 are rounded off to facilitate the mounting of the base member 11 on the mounting member such as the belt B shown by phantom lines in FIG. 1.

The front leg 21 on the base member 11 has a locating dimple 30 formed therein which projects outwardly from the front surface 31 of the leg 21. This forms a recess 32 behind dimple 30 which opens onto the back surface 34 of the front leg 21 on base member 11 as best seen in FIG. 4. Recess 32 has a depth $d_1$ as seen in FIG. 4 as will become more apparent. The dimple 30 forms thereon an annular shoulder 35 of outside diameter $d_2$ at its base joining with the front surface 31 on the leg 21 as best seen in FIG. 4. It will also be noted that the projecting end 36 of the dimple 30 is generally parallel to surface 31 and displaced forwardly thereof. The projecting end 36 defines an inside flat surface 38 thereon of diameter $d_3$ (FIG. 4) as will become more apparent. Thus, it will be seen that the dimple is centered on an axis $A_D$ which is oriented generally normal to the axis $A_{BM}$ of the base member 11. The projecting end 36 of the dimple 30 also defines a hole 39 therethrough concentrically of the dimple axis $A_D$ with a diameter $d_4$ as will become more apparent. The rear leg 22 of the base member 11 defines a hole 40 therethrough with a diameter larger than the diameter $d_3$ of the surface 34. The hole 40 is also concentric of the dimple axis $A_D$ to permit the fastener 15 to be installed as will become more apparent.

The tool clip member 12 is also formed from an elongate piece of material. The tool clip member 12 has a central section 50 with a central axis $A_{TC}$ and a pair of arcuate legs 51 integrally connected with opposite ends of the central section 50 and projecting outwardly and forwardly of the central section 50 to eventually curve inwardly toward each other. The central section 50 also defines a locating dimple 52 therein centered on the axis $A_{TC}$ and oriented along a dimple axis $A_D$ generally normal to the axis $A_{TC}$. The dimple 52 projects rearwardly of the rear surface 54 (FIG. 1) of the central section 50. This forms a recess 55 under dimple 52 which opens onto the front surface 56 of the central section 50 as best seen in FIG. 4. Recess 55 has a depth $d_5$ as seen in FIG. 4 as will become more apparent. The dimple 52 corresponds to dimple 30 and thus forms an annular shoulder 58 thereon also of diameter $d_2$ at its base joining with the rear surface 54 on the central section 50 as best seen in FIG. 4. The projecting end 59 of the dimple 52 is generally parallel to surface 54 and is displaced rearwardly thereof. The end 59 defines a forwardly facing inside flat surface 60 thereon of diameter $d_6$ (FIG. 4) as will become more apparent. The projecting end 59 defines a hole 61 therethrough of diameter $d_4$ to match that of hole 39. Hole 61 is also concentric of the axis $A_D$.

The dimple 52 serves to reinforce the central section 50 of the tool clip member 12. This causes the central section 50 to be maintained substantially flat so that the integral connections between the arcuate legs 51 and the opposite ends of the central section 50 forming a pair of spaced apart bend lines 70 oriented generally normal to the axis $A_{TC}$. This permits adjustability of the clip member 12 without affecting the operation of holder 10 as will become more apparent.

The tool gripping legs 51 first curve outwardly away from each other and forwardly of the central section 50 and then curve inwardly toward each other still extending forwardly of the central section 50. The outer projecting ends of the legs 51 are rounded off as indicated in 71 to assist in installing the tool such as flashlight F into the tool clip member 12 and the projecting ends of each of the legs 51 are also bent outwardly away from each other to form the guide tabs 72 thereon so that when the tool such as flashlight F is forced toward the central section 50 of the tool clip member 12, the tabs 72 force the legs 51 apart so that the flashlight F can pass between the legs 51 to be held in position.

The material selected from the tool clip member 12 has an affect on its overall operation. Material with little resilience will not allow the legs 51 to be forced apart so that the tool such as flashlight F can be inserted between tabs 72 while still resiliently recovering sufficiently to grip the tool after it is inserted in tool clip member 12. On the other hand, material with a lot of resilience would allow the tool to be clipped into member 12; however, the tool diameter would have to be within a limited size range in order to be adequately held. By using a material which has a certain amount of resiliency and which also has a sufficiently low yield strength, however, the tool receiving opening 74 between the legs 51 can be manually changed by forcing the legs 51 toward or away from each other with sufficient force to exceed the yield strength of the material and bend the legs 51 along bend lines 70. The resiliency of the material still allows a tool shown by phantom line $F_1$ within the diameter range to which the legs 51 are adjusted to be inserted in the clip member 12 and be gripped by legs 51 to hold it in place. While a number of different materials may be used, No. 30304 stainless steel has been found satisfactory where the width $w_1$ of the legs 51 is nominally one inch (2.54 cm) and the leg thickness $t_1$ is about 0.03 inch (0.76 mm). This allows the legs 51 to be bent inwardly as shown by dashed lines in FIG. 2 to hold a smaller diameter tool shown by phantom line $F_2$ or outwardly about bend lines 70 without significantly changing the shape of legs 51. The effective radius of curvature $R_L$ of legs 51 seen in FIG. 2 is selected to permit a wide range of tool diameters to be accommodated.

The compression coil spring 14 has an inside diameter $d_{10}$ (FIG. 4) which is about equal to the outside diameters $d_2$ of the shoulders 35 and 58 on the dimples 30 and 52 so that the coil spring 14 just fits over the dimples. The dimples 30 and 52 maintain the axis of the coil spring 14 coaxial of the dimple axes $A_D$ as seen in FIG. 2. The coil spring 14 has an uncompressed length $L_1$ as seen in FIG. 1 but is maintained compressed to a length $L_2$ as seen in FIG. 2 by the fastener 15 as will become more apparent. FIG. 4 also shows spring 14 in its compressed condition. Because the dimples 30 and 52 maintain the coil spring 14 concentrically of the dimple axis $A_D$, the engagement of the coil spring 14 with the front surface 31 on the base member 11 and the rear surface 54 on the central section 50 of tool clip member 12 serves to maintain the front surface 31 on the base member 11 and the rear surface 54 on the tool clip member 12 generally parallel to each other. This is because the compression coil spring 14 is of the "squared and ground" type with both ends ground normal to the spring axis and with the end flights of the spring 14 engaging the surfaces 31 and 54 for substantially 360° about the dimple axes $A_D$. This causes the central axes $A_{BM}$ and $A_{TC}$ to remain substantially parallel to each other as the base member 11 and tool clip member 12 are rotated relative to each other about the dimple axis $A_D$.

The characteristics of the spring 14 also have an effect on the operation of the holder 10 since it is the force of the spring 14 on the base member 11 and tool clip member 12 which controls the frictional interface between the fastener 15 and the members 11 and 12. This frictional interface should be great enough that the weight of the tool such as flashlight F is not sufficient to rotate members 11 and 12; however, it is not so great as to prevent the user from manually overcoming the effect of the frictional interface so that the user can manually rotate the members 11 and 12 to adjust the orientation of the tool. While a wide variety of springs 14 may be used, a stainless steel compression coil spring with a spring constant of about 70 lbs/in. has been found satisfactory when it is maintained compressed by about 0.25 inch.

The fastener 15 is illustrated as a rivet which has an enlarged head 75 at one end thereof and a cylindrical shank 76 which is bucked at its projecting end to hold the rivet 15 in place. The shank 76 has a diameter $d_{11}$ while the head 75 has an outside diameter $d_{12}$. The shank 76 has a length $L_3$ in its undeformed state as seen in FIG. 1 but is bucked to an effective shank length $L_4$ as seen in FIG. 2 when it is installed. The bucked end 78 of the rivet 15 is best seen in FIG. 2. It will be noted that the rivet 15 can be installed from either direction through the members 11 and 12 so that the underside of the head 75 engages the inside surface 60 of the end section 59 of the dimple 52 while the underside of the bucked end 78 of the rivet 15 engages the inside surface 38 of the end section 36 of the dimple 30. If the rivet is installed in the opposite direction, then the head 75 would engage the dimple 30 while the bucked end 78 would engage the dimple 52. The outside diameter $d_{12}$ of head 75 on rivet 15 and the outside diameter $d_{14}$ of the bucked end 78 are smaller than the diameters $d_3$ and $d_6$ of the inside surfaces 38 and 60 on dimples 30 and 52. The rivet 15 is bucked so that both the underside of head 75 and the underside of bucked end 78 are normal to the shank axis so that the axes $A_{BM}$ and $A_{TC}$ are maintained generally parallel. The shank diameter $d_{11}$ is such that the rivet shank 76 is received through the holes 39 and 61 in dimples 30 and 52 in clearance. A bolt may be used in lieu of the rivet 15.

The holder 10 is assembled by placing the spring 14 between the members 11 and 12 and over the dimples 30 and 52 with the dimples 30 and 52 facing each other and with the dimple axes $A_D$ coaxially aligned. The fastener 15 is inserted through the holes 39 and 61 in dimples 30 and 52. While the members 11 and 12 are forced toward each other, the fastener 15 is bucked in place to form the bucked end 78 thereon. The members 11 and 12 are then released so that the movement of the members 11 and 12 away from each other is limited by the head 75 and bucked end 78 on rivet 15 to keep spring 14 in compression. The shank 76 on rivet 15 keeps the dimple axes $A_D$ coaxially aligned. The amount of compression maintained in spring 14 can be adjusted by bucking the rivet 15 to different lengths.

An attachment member 80 (FIGS. 1 and 3) may be provided for removably attaching the holder 10 to a fixed surface FS (FIG. 3) such as a wall. The attachment member 80 may have a number of different configurations and is illustrated as a U-shaped member with a pair of generally parallel legs 82 connected at one end by a curved end section 82 to form a clip receiving space 84 between legs 81. The other end of one of the legs 81 mounts a transversely extending spacer 85, here shown mounted on the front leg 81 so that spacer 85 moves with front leg 81. The spacer 85 closes the opposite end of space 84 from end section 82. The projecting height of the spacer 85 is such that the base member 11 can be removed thereover when the rear leg 22 thereof is received in space 84.

The resiliency of the member 80 is such that spacer 85 normally closes space 84 but the front leg 81 can be deflected forwardly to open up space 84. The length of the space 84 is such that the base member 11 can be clipped over the front leg 81 of member 80 with leg 22 on member 11 extending through space 84 and captivated between the end section 82 and spacer 85 on attachment member 80. The base member 11 can then be removed by lifting up on the holder 10 or by moving the holder 10 so that the leg 22 on base member 11 passes over the spacer 85.

The rear leg 81 on attachment member 80 is provided with an adhesive strip 86 with a removable protector strip 88. The protector strip 88 is removed and the adhesive strip 86 used to fixedly mount the attachment member 80 to the surface FS.

I claim:

1. A tool mounting assembly for removably mounting and positioning a tool such as a flashlight comprising:

a base member for mounting said assembly, said base member defining a generally flat base surface thereon and including a first dimple projecting outwardly from said base surface about a first dimple axis generally normal to said base surface, said first dimple comprising a first annular shoulder projecting outwardly from said base surface concentrically of the first dimple axis and a first dimple end wall integral with that end of said first annular shoulder outwardly of said base surface, said first dimple end wall oriented generally parallel to said base surface and spaced outwardly of said base surface, said first dimple end wall defining a first hole therethrough concentrically of said first dimple axis;

a tool clip member for removably mounting said tool therein, said tool clip member defining a generally flat clip surface thereon and including a second dimple projecting outwardly from said clip surface about a second dimple axis generally normal to said clip surface, said second dimple comprising a second annular shoulder projecting outwardly from said clip surface concentrically of the second dimple axis and a second dimple end wall integral with that end of said second annular shoulder outwardly of said clip surface, said second dimple end wall oriented generally parallel to said clip surface and spaced outwardly of said clip surface, said second dimple end wall defining a second hole therethrough concentrically of the second dimple axis, said base member and said tool clip member oriented so that said first and second dimples face each other with said first and second holes coaxially aligned;

a compression coil spring having a spring axis and opposed ends oriented normal to said spring axis positioned between said base member and said tool clip member so that one end of said spring fits over said first dimple and engages said base surface and the other end of said spring fits over said second dimple and engages said clip surface, said first annular shoulder on said first dimple maintaining that end of said spring engaging said base surface concentrically of first dimple axis and said second annular shoulder on said second dimple maintaining that end of said spring engaging said clip surface concentrically of the second dimple axis; and fastening means of a fixed length rotatably extending through said first and second holes in said dimples and through said spring, said fastening means engaging said first and second dimple end walls to limit the movement of said base member and said clip member away from each other and keep said coil spring in compression with said first dimple spaced from said second dimple so that said coil spring resiliently forces said base member and said tool clip member toward a position with the first dimple axis coaxial with the second dimple axis and with said base surface parallel to said clip surface to positively locate said base member with respect to said tool clip member yet allows said base member to be moved with respect to said tool clip member so that said base surface and said clip surface are not parallel and so that said coil spring resiliently forces said first dimple end wall on said base member and said second dimple end wall on said tool clip member into frictional engagement with said fastening means to frictionally maintain the relative rotational position of said base member and said clip member, yet allows the relative rotational position to be manually changed by overriding the frictional engagement maintained by said spring.

2. The tool mounting assembly of claim 1 for mounting the tool on the user's clothing wherein said base member includes resilient clipping means for removably mounting said base member and thus said tool mounting assembly in selected positions on the user's clothing.

3. The tool assembly of claim 2 wherein said fastening means includes locking means on opposite ends thereof engaging said first dimple end wall on said base member and said second dimple end wall on said tool clip member to limit the movement of said tool clip member and said base member away from each other; and wherein each of said dimples defines a recess therein sized larger than said locking means to receive said locking means therein to prevent interference between said locking means and the operation of said base member in mounting said tool mounting assembly on the user's clothing and between said locking means and the operation of said tool clip member in mounting the tool.

4. The tool mounting assembly of claim 3 wherein said tool clip member includes a central section defining said clip surface thereon and a pair of resilient arcuate tool gripping legs integral with opposite ends of said central section, said tool gripping legs curving away from said central section and toward each other at the projecting ends thereof so as to resiliently engage the tool to support the tool in said clip member, said second dimple on said tool clip member formed on said central section to reinforce said central section and maintain said central section generally flat as said legs grip said tool.

5. The tool mounting assembly of claim 4, wherein said tool clip member is made out of a material having limited resilience and a non-elastic yield strength such that said tool gripping legs can be bent at their juncture with said central section to adjust the tool gripping capability of said tool clip member while still causing said tool gripping legs to grip a particular size range of the tools while said second dimple prevents bending of said central section.

6. The tool mounting assembly of claim 5 wherein said fastening means includes a rivet having an enlarged head at one end and an enlarged bucked end opposite said head to limit the movement of said base member and said tool clip member away from each other.

7. The tool mounting assembly of claim 6 adapted to be removably mounted on a fixed surface including an attachment member, said attachment member including a pair of legs having overlapping projecting ends resiliently urged toward each other, spacing means mounted on the projecting end of one of said legs to maintain said legs in a spaced apart position, and mounting means for fixedly attaching one of said legs to the fixed surface so that the other of said legs on said attachment member can be engaged by said clipping means on said base member to removably mount said tool mounting assembly thereon.

8. A tool mounting assembly for removably mounting and positioning a tool such as a flashlight on a convenient relatively thin support member comprising:

a base member for removably connecting the tool mounting assembly onto the thin support member, said base member including a resilient front leg and a resilient rear leg spaced from each other to removably grip the thin support member therebetween, said front leg defining a generally flat front surface thereon on that side of said front leg opposite said rear leg, said front leg further including a first dimple formed therein and projecting outwardly from said front surface about a dimple axis generally normal to said front surface, said first dimple including an annular shoulder concentric of the dimple axis and a dimple end wall integral with that end of said annular shoulder projecting from said front surface, said dimple end wall defining a hole therethrough concentrically of the dimple axis;

a tool clip member for removably mounting the tool therein, including a central section and a pair of resilient arcuate legs integral with opposite sides of said central section, said central section defining a generally flat surface on that side of said central section opposite said arcuate legs, said central section further including a second dimple formed therein and projecting outwardly from said flat surface about a dimple axis generally normal to said flat surface, said second dimple including an annular shoulder concentric of the dimple axis and a dimple end wall integral with that end of said annular shoulder projecting from said flat surface, said dimple end wall defining a hole therethrough concentrically of the dimple axis, said base member and said tool clip member oriented so that said dimples face each other and said holes through said dimple end walls are generally coaxially aligned;

a compression coil spring having a spring axis and opposed ends normal to the spring axis positioned between said base member and said tool clip member so that one end of said coil spring fits around said first dimple on said base member and engages said flat front surface on said base member and the other end of said coil spring fits around said second dimple on said tool clip member and engages said flat surface on said tool clip member whereby said annular shoulders on said first and second dimples maintain said opposed ends of said coil spring concentrically of said holes through said dimple end walls; and a rivet of a fixed length extending through said coil spring and said holes in said dimple end walls and engaging said dimple end walls to limit the movement of said base member and said tool clip member away from each other and maintain said coil spring compressed between said surfaces, whereby said rivet and said spring cooperate to said base member and said tool clip member to pivot with respect to each other, the distance between the points of engagement between said dimple ends walls and said rivet being less than the distance between said front surface on said base member and said flat surface on said tool clip member so that said coil spring resiliently maintains said front surface on said base member parallel to said flat surface on said tool clip and so that said coil spring resiliently forces said dimple end walls on said base member and said tool clip member into frictional engagement with said rivet to frictionally maintain the relative rotational position of said base member and said clip member, yet allows the relative rotational position to be manually changed by overriding the frictional engagement maintained by said spring.

* * * * *